US006050662A

United States Patent [19]

Filipek et al.

[11] Patent Number: 6,050,662

[45] Date of Patent: Apr. 18, 2000

[54] MODULAR SYSTEM BOARD

[75] Inventors: Gregory C. Filipek, Garden Grove; Steven T. Jersey, Laguna Niguel; Brian Babson, Irvine, all of Calif.

[73] Assignee: Shurflo Pump Manufacturing Co., Santa Ana, Calif.

[21] Appl. No.: 09/064,321

[22] Filed: Apr. 22, 1998

[51] Int. Cl.[7] ..... A47B 97/00

[52] U.S. Cl. ..... 312/352; 248/674; 206/560; 312/223.1

[58] Field of Search ..... 312/352, 223.1, 312/31; 206/319, 561, 564, 560; 211/87.01, 13.1; 248/674, 314

[56] References Cited

U.S. PATENT DOCUMENTS

| | | | |
|---|---|---|---|
| D. 253,704 | 12/1979 | McGraw . | |
| D. 380,479 | 7/1997 | Cantley et al. . | |
| D. 388,439 | 12/1997 | Cantley et al. . | |
| 3,879,068 | 4/1975 | Stampfli . | |
| 4,247,133 | 1/1981 | Moller . | |
| 4,361,226 | 11/1982 | Travis | 206/564 X |
| 4,483,365 | 11/1984 | Fallon . | |
| 4,643,335 | 2/1987 | Carnisio . | |
| 4,735,310 | 4/1988 | Lemery et al. | 206/319 |
| 4,747,495 | 5/1988 | Hoss | 206/319 X |
| 4,816,496 | 3/1989 | Nishitani et al. . | |
| 5,011,011 | 4/1991 | Kidd | 206/319 |
| 5,199,567 | 4/1993 | Discko et al. | 206/564 X |
| 5,215,726 | 6/1993 | Kudla et al. | 206/564 X |
| 5,314,092 | 5/1994 | Credle, Jr. . | |
| 5,480,288 | 1/1996 | Hellenberg et al. . | |
| 5,492,455 | 2/1996 | Durham et al. . | |
| 5,524,983 | 6/1996 | Dittgen et al. . | |
| 5,607,083 | 3/1997 | Vogel et al. . | |
| 5,624,167 | 4/1997 | Katz | 312/223.1 |
| 5,626,467 | 5/1997 | Cantley . | |
| 5,795,005 | 8/1998 | Garfias et al. | 296/37.5 |

FOREIGN PATENT DOCUMENTS

| | | |
|---|---|---|
| 0085588 | 8/1983 | European Pat. Off. . |
| 0661236 | 12/1994 | European Pat. Off. . |
| 8707236 | 12/1987 | WIPO . |
| 9606798 | 3/1996 | WIPO . |

*Primary Examiner*—Peter R. Brown
*Assistant Examiner*—Stephen Vu
*Attorney, Agent, or Firm*—Stout, Uxa, Buyan & Mullins LLP; Frank J. Uxa

[57] ABSTRACT

Apparatus for holding any one of a plurality of differently configured pumps to facilitate use of such pumps, for example, in dispensing beverages. The apparatus includes a housing and a plurality of different sets of elements located on the housing. Each different set of elements is adapted to at least assist in holding one of a plurality of differently configured pumps to the housing. The apparatus can be linked together to very effectively and conveniently provide for the management and maintenance of a relatively large number of pumps, being used in dispensing a correspondingly relatively large number of beverages.

7 Claims, 4 Drawing Sheets

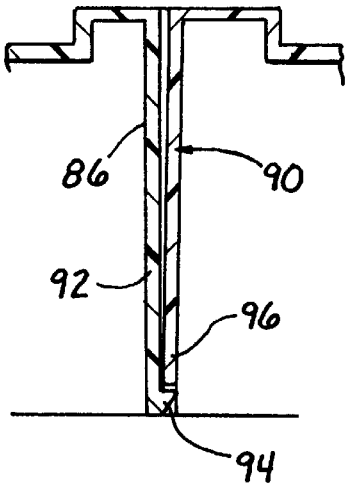
Fig. 3
Fig. 4
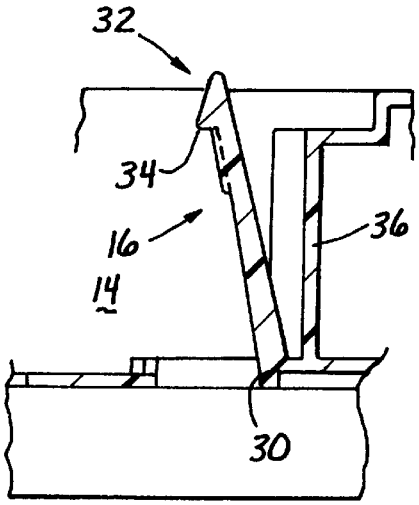
Fig. 5
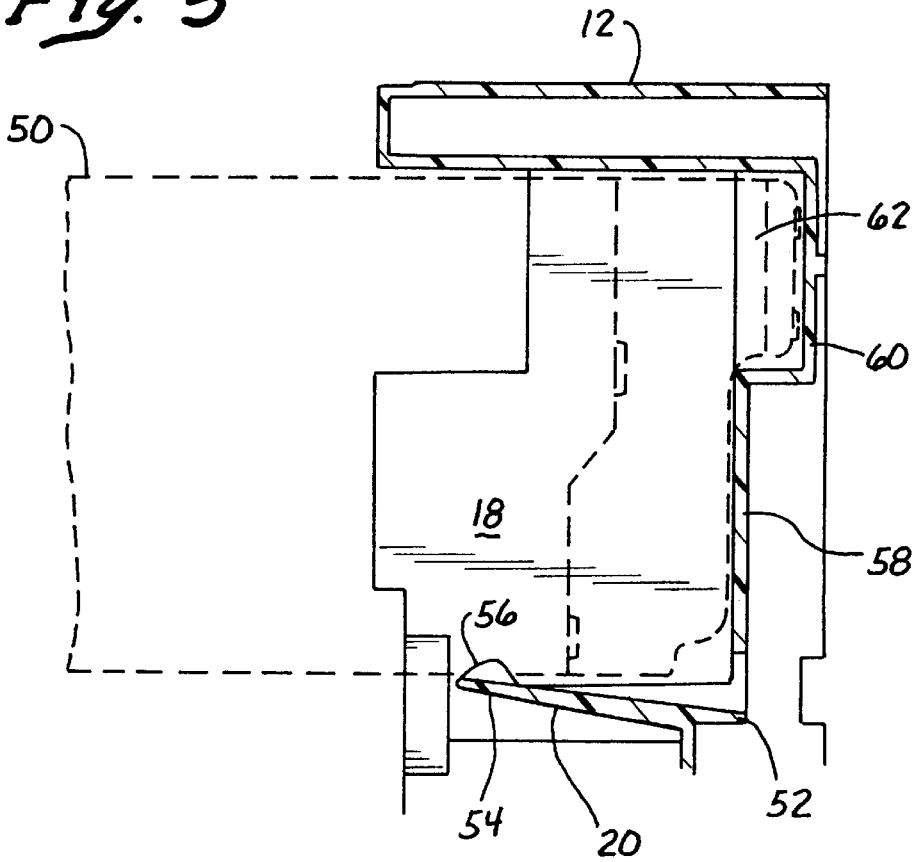

12
84A
84
84A
81
80
82
70
92
94
24
94
92
84A
84
84A
74
72
78
22

MODULAR SYSTEM BOARD

BACKGROUND OF THE INVENTION

The present invention is directed to apparatus useful for holding any one of a plurality of differently configured pumps. More particularly, the invention is directed to apparatus or modular system boards useful for holding any one of a plurality of differently configured pumps so that the pump can be effectively used, for example, in combination with one or more other such held pumps, in the dispensing of beverages and the like applications.

The service of beverages in commercial establishments, such as restaurants, taverns and the like, often involves a series of containers, for example, bag-in-box containers, for different beverages, such as beer, wine and the like, or beverage components, such as flavored syrups and the like. Each of these containers is associated with a pump which provides the beverage or beverage component to a dispensing valve. If, as is often the case, the establishment dispenses a large number of different beverages, the number of pumps, of example, of different sizes and/or configurations, is also large so that the pumps can become difficult to manage and maintain. Also, when two or more containers are used in dispensing a single beverage, an automatic selector valve (ASV) is often placed between the containers and the pump to automatically switch between an empty container and a full container for uninterrupted dispensing of the beverage. Such ASVs can add to the problem of managing and maintaining commercial beverage dispensing systems.

It would be advantageous to provide apparatus which provide ordered arrangements of pumps and, in applicable situations, ASVs, for more effective management and maintenance of pumping, for example, beverage dispensing, systems.

SUMMARY OF THE INVENTION

Apparatus for holding any one of a plurality of differently configured pumps have been discovered. Such apparatus allow any one of a plurality of differently configured pumps to be held by the apparatus while the pump is in use, for example, in dispensing a beverage or a beverage component. The apparatus are effective in holding pumps of different configurations, for example, from different manufacturers, and/or different sized pumps of similar configurations, for example, from the same manufacturer, so that the user is not constrained to use a specific pump in order to provide for effective management and maintenance of a system of pumps, for example, an eating and/or drinking establishment's beverage dispensing pumps. In addition, the present apparatus preferably are adapted to hold ASVs, thereby further increasing the effectiveness of managing/maintaining beverage dispensing systems.

Although a single one of the present apparatus can be used alone, preferably two or more of these apparatus are used together, for example, coupled together to hold different pumps, or pumps and ASVs, as part of a beverage dispensing system or the like system involving a plurality of pumps. The apparatus may be considered modular system boards or modular pump system boards because each apparatus is a module that can be used alone or included in a multi-module system.

The present apparatus are straightforward in construction, preferably are adapted to be joined or coupled together, for example, at a remote location, thereby reducing or even eliminating on-site assembly and installation labor and costs. In general, the present apparatus facilitate very cost and performance effective management and maintenance of pumps and pumping systems.

In one broad aspect of the present invention, the present apparatus or pump system boards comprise a housing and a plurality of different sets of elements or features located on the housing. Each different set, including one, two or more elements or features, is adapted to at least assist in holding one of a plurality of differently configured pumps to the housing. Thus, the housing, preferably secured to a wall or other structural member, is effective in holding the pump in a stationary place so that it can be easily installed, managed, e.g., monitored, and maintained. Each set of elements or features preferably is exclusive in that element or elements in any given set do not cooperate with the element or elements of any other set in holding a pump to the housing. Preferably, each of the present apparatus is adapted to be linked, coupled or joined together with one or more other such apparatus. These linked systems can be conveniently pre-assembled, for example, remote or away from the places where the systems are to be ultimately used, so as to reduce onsite system assembly and installation time, labor and costs. Such linked systems are very effective in situations where two or more pumps are used, for example, in dispensing beverages from containers, such as bag-in-box containers and the like.

The housing and plurality of different sets of elements or features preferably are of unitary construction and/or preferably are made of polymeric material. Thus, the present apparatus can be molded or otherwise formed into a single piece which is very cost effective, without reducing performance effectiveness.

In one embodiment of the present invention, one of the different sets of elements of the present apparatus includes a first cavity defined by the housing and sized and adapted to receive a portion of one of a plurality of differently configured pumps. A plurality of spaced apart clips extend in the first cavity, for example, from the backwall of the first cavity, and are adapted to hold the received portion of the pump in the first cavity. This set of elements preferably is useful in holding an ASV to the housing. Thus, the first cavity preferably is further sized and adapted to receive a portion of an ASV, and the plurality of spaced apart clips preferably are further adapted to hold the received portion of the ASV in the first cavity.

The apparatus preferably includes 2 to about 6, more preferably 4, of the spaced apart clips. The first cavity may be sized to receive a portion of any one of two or more similarly configured pumps of different sizes, and the plurality of spaced apart clips may be adapted to hold the received portion of any one of two or more similarly configured pumps of different sizes. The ability to hold different sized, similarly configured pumps is an important feature in that the flexibility or usefulness of the apparatus is enhanced.

Each of the spaced apart clips preferably is biased toward the interior of the first cavity and has a free end configured to contact, more preferably grip, the pump a portion of which is received in the first cavity. The plurality of spaced apart clips preferably are unitary with the housing.

In a useful embodiment of the invention, one of the different sets of elements or features includes a second cavity defined by the housing. A cavity clip defines a portion of the second cavity. This second cavity is sized and adapted to receive a portion of one of a plurality of differently configured pumps. The cavity clip is adapted to hold the received portion of the pump in the second cavity.

The cavity clip preferably is biased toward the interior of the second cavity and has a free end configured to contact, more preferably grip, the pump a portion of which is received in the second cavity. The cavity clip preferably is unitary with the housing. In one embodiment, the second cavity has a back wall including a first part and a second part which is positioned rearwardly of the first part. This "uneven" back wall of the second cavity is effective in holding at least one pump to the housing.

In one embodiment of the present invention, one of the different sets of elements or features includes at least one hook and at least one hole spaced apart from the hook. The hook is sized and adapted to receive a portion of one of the plurality of differently configured pumps. The housing may be configured to cooperate with the hook in receiving a portion of the pump. The hole is sized and adapted to receive a portion of a pin member coupled to the pump received by the hook. The combination of the hook, the hole and the pin member is effective to hold the pump received by the hook to the housing.

Two spaced apart hooks and two spaced apart holes preferably are included. The hook or hooks preferably are unitary with the housing.

In very useful embodiments of the present invention any two or all three of the above-noted different sets of elements or features are included on a single housing.

The present apparatus preferably further comprise coupling means acting to cooperate with complimentary coupling means of a similar apparatus to couple the apparatus to the similar apparatus. Any coupling element or elements effective to link together two apparatus of the present invention, for example, two identically configured apparatus of the present invention, may be utilized in the coupling means. Preferably, one portion of the coupling means compliments a second portion of the coupling means. For example, one portion of the coupling means may be a bolt, screw, pin and the like and the second portion of the coupling means may be a bore or hole sized and adapted, e.g., threaded, to receive the bolt, screw, pin and the like. Preferably at least a portion, more preferably all, of the coupling means is unitary with the housing.

In one particularly useful construction, the coupling means includes a projection extending outwardly from a first sidewall of the housing and a recess extending inwardly from an opposing second sidewall of the housing. The projection is adapted to matingly engage a complimentary recess of a similar apparatus. The recess is adapted to matingly engage a complementary projection of a similar apparatus. In this construction, the coupling means preferably includes two of the projections and two of the recesses, with each projection being spaced apart from the other projection and each recess being spaced apart from the other recess.

The apparatus preferably further comprises anti-sliding means acting to cooperate with complementary anti-sliding means of a similar apparatus coupled to the apparatus to prevent the apparatus sliding, for example, sliding forwardly, relative to the similar apparatus. The anti-sliding means advantageously is oriented so as to prevent, or at least reduce the risk of, the apparatus unintentionally or inadvertently decoupling or separating from the apparatus to which it is coupled. The anti-sliding means of one apparatus may establish cooperation with the complementary anti-sliding means of another apparatus as the two apparatus are coupled together. In a very useful embodiment, the anti-sliding means is disengaged, for example, manually disengaged, from cooperation with the complementary anti-sliding means before the apparatus and similar apparatus are separated or decoupled.

Any element or elements effective to prevent two apparatus of the present invention, for example, two identically configured apparatus of the present invention, from sliding relative to each other when coupled may be utilized in the anti-sliding means. Preferably, one portion of the anti-sliding means complements a second portion of the anti-sliding means. In one embodiment, the anti-sliding means and coupling means may be one in the same, for example, in the event the coupling means includes a bolt, screw, pin and the like, such implement can also act to prevent the sliding of one apparatus relative to a similar apparatus in accordance with the present invention.

In one construction, the anti-sliding means includes a flap or tab extending from a first sidewall of the housing and a shortened flap or tab extending from an opposing second sidewall of the housing. The flap or tab has a free end which extends outwardly from the first sidewall and is adapted to be located in proximity to a complementary shortened flap or tab of a similar apparatus coupled to the apparatus so that the free end of the flap extends below the complementary shortened flap of a similar apparatus. The shortened flap or tab is adapted to be located above the free end of a complementary flap or tab of a similar apparatus coupled to the apparatus. The anti-sliding means preferably includes two, spaced apart flaps or tabs and two, spaced apart shortened flaps or tabs.

Any two or more features described herein can be included in a combination within the scope of the present invention, provided that the features included in such combination not mutually inconsistent.

These and other aspects and advantages of the present invention are apparent in the following detailed description of the invention and claims, particularly when considered in conjunction with the accompanying drawings in which like parts bear like reference numerals.

BRIEF DESCRIPTION OF THE DRAWINGS

FIG. 3 is a cross-sectional view taken generally along line 3—3 of FIG. 2.

FIG. 4 is a cross-sectional view taken generally along line 4—4 of FIG. 2.

FIG. 5 is a cross-sectional view taken generally along line 5—5 of FIG. 2.

DETAILED DESCRIPTION OF THE DRAWINGS

Figure 1:
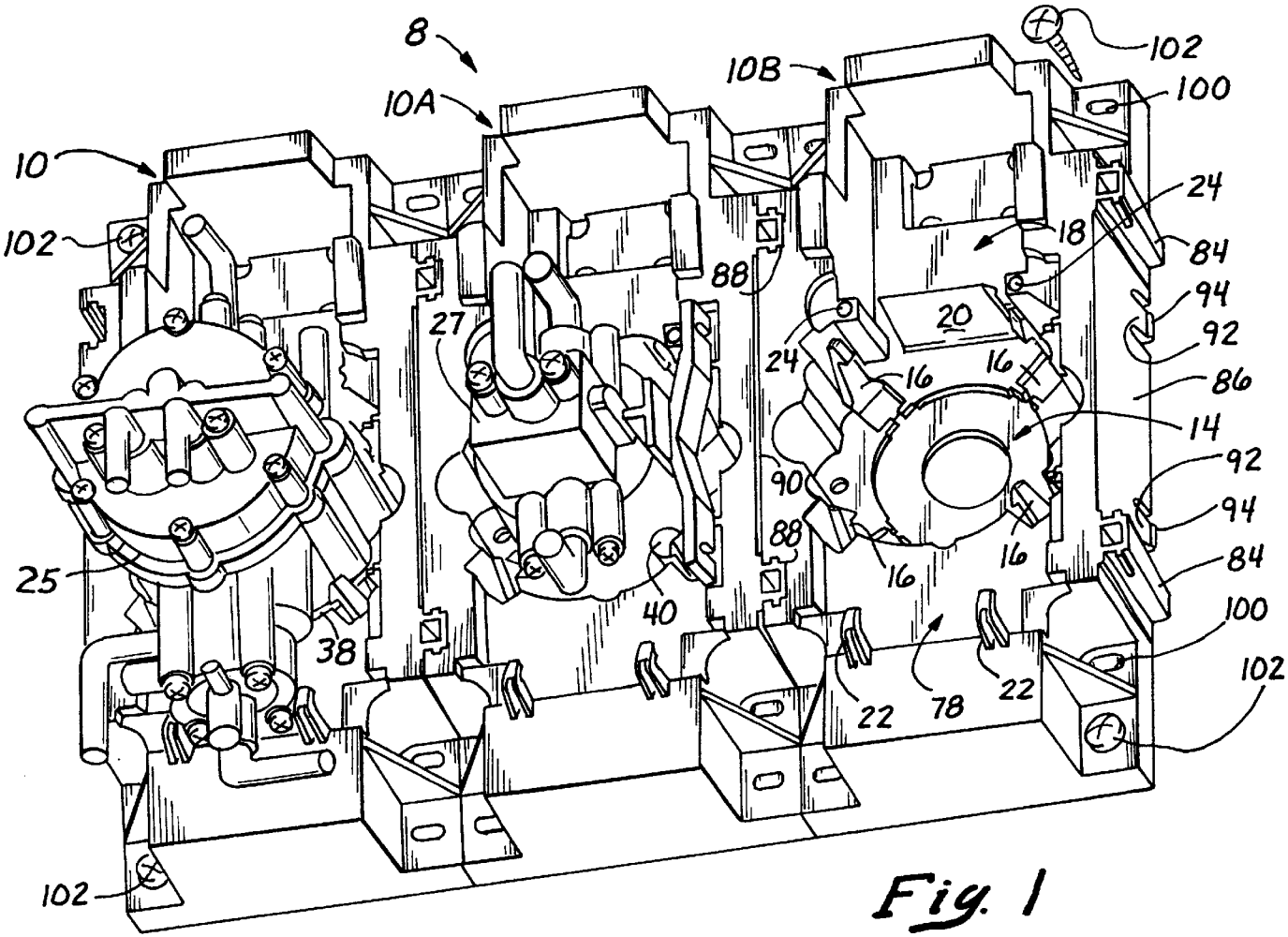
FIG. 1 is a front side view, in perspective of a series of three (3) apparatus in accordance with the present invention.

Referring now to the drawings, FIG. 1 shows a partially assembled beverage pumping system, shown generally at 8, including three identically configured modular system boards 10, 10A and 10B in accordance with the present invention, linked or coupled together. The structure of board 10B is described in detail. However, it should be understood that each of the other boards 10 and 10A have the exact same structure.

Figure 2:
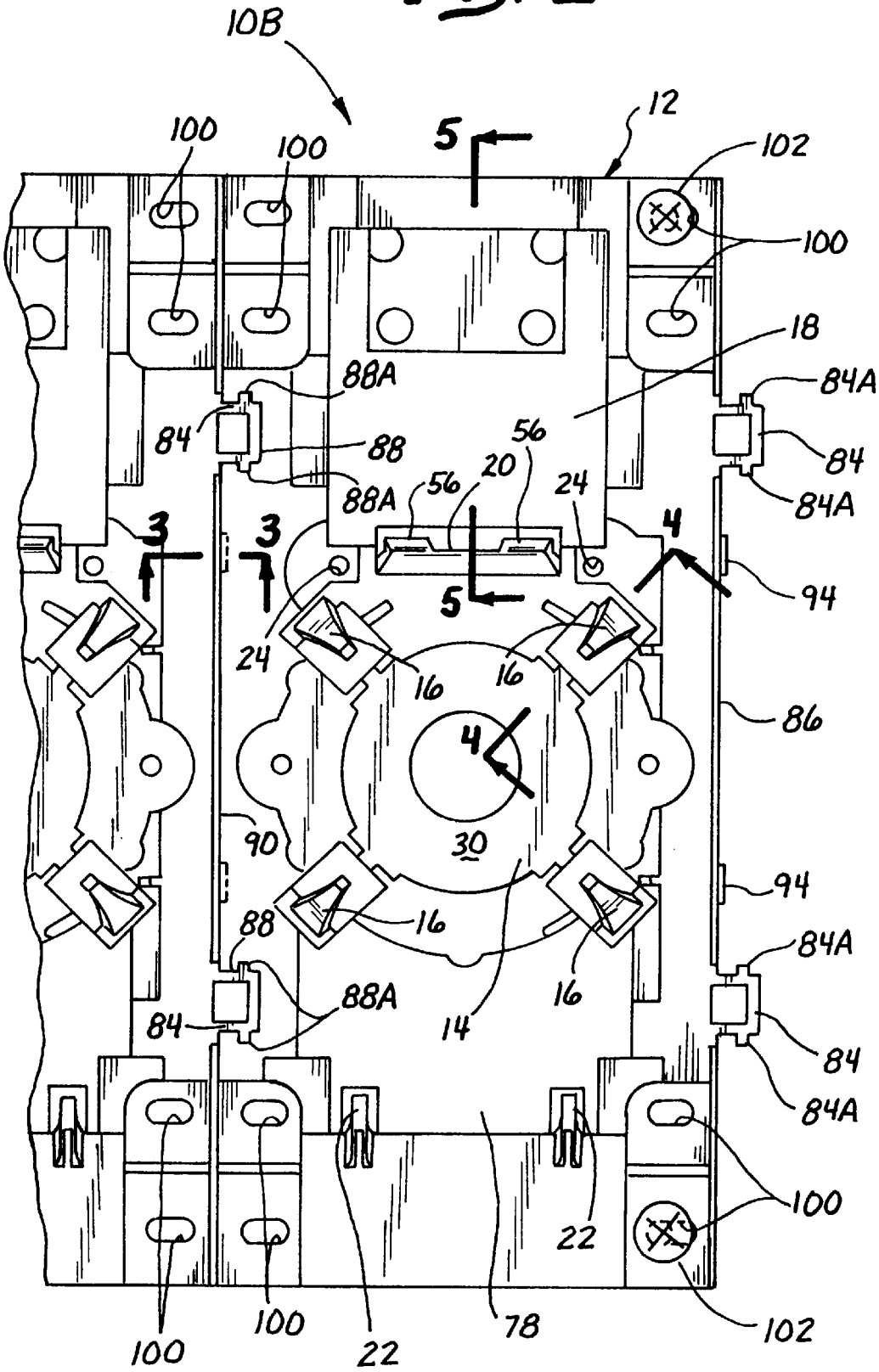
FIG. 2 is a front plan view of one of the apparatus in accordance with the present invention shown in FIG. 1.

With particular reference to FIGS. 1 and 2, the modular system board 10B includes a housing 12, a first cavity 14, a series of four spaced apart clips 16, a second cavity 18, a cavity clip 20, two spaced apart hooks 22 and two spaced apart holes 24. The combination of first cavity 14 and spaced apart clips 16 define a first set of elements. Second cavity 18 and cavity clip 20 define a second set of elements and spaced apart hooks 22 and spaced apart holes 24 define a third set of elements. All three sets of elements are located on or in housing 12, which is of unitary construction and made from a polymeric material, for example, such as polyethylene or other suitable polymeric material.

First cavity 14 is sized and configured to receive a portion of pump 25 or ASV 27 (FIG. 1). Pump 25 can be a pump sold by SHURflo Pump Manufacturing Company under Model 166-2XX-XX. ASV 27 can be a valve sold by SHURflo Pump Manufacturing Company under Model 165-XXX and is used in selecting from among a plurality of containers containing a beverage or a beverage component, for example, a flavored syrup for soft or carbonated drinks. The pumps and ASV in the drawings are not shown fully plumbed to improve illustrative clarity. However, it should be understood that the pumps and ASV shown have the appropriate tubing/piping connections between containers for beverages or beverage components and dispensing valves through which the final beverage is passed to be consumed.

The first cavity 14 is effectively sized so as to accommodate either pump 25 or a smaller version of a similarly configured pump, that is the pump sold by SHURflo Pump Manufacturing Company under Model 166-2XX-XX.

The spaced apart clips 16 are shown in more detail in FIG. 4. Thus, clip 16 extends from the back wall 30 of first cavity 14 and terminates in a free end 32 which extends, in the unstressed state, outwardly at least partially beyond first cavity 14. Free end 32 includes an inwardly extending notch 34 which is adapted to contact, and preferably grab, the pump 25 or ASV 27 placed in first cavity 14.

As shown in FIG. 4, in the unstressed condition, clip 16 is biased inwardly into first cavity 14. As the pump 25 or ASV 27 is placed into first cavity 14, the clips 16 are forced back toward the sidewall 36 of first cavity 14. However, because of the inward bias of clips 16, the clips resist this movement and act to hold the pump 25 or ASV 27 in first cavity 14. In addition, the notch 34 is configured so as to grip the rim 38 of pump 25 (board 10 in FIG. 1) or the frame segment 40 of ASV 27 (board 10A in FIG. 1), thereby providing a positive holding or gripping force restraining the pump 25 and ASV 27, respectively, from leaving the first cavity 14. When it is desired to remove pump 25 and ASV 27 from first cavity 14, the spaced apart clips 16 are simply manually moved toward the sidewall 36 of first cavity 14. This movement allows the pump 25 or ASV 27 to be removed from the first cavity 14.

With particular reference to FIG. 5, the second set of elements including second cavity 18 and cavity clip 20 are shown holding a pump 50 (shown in shadow lines) to housing 12. Pump 50 is configured similarly to a pump sold by Flojet, Inc. under Model 50XX.

Cavity clip 20 extends from the back wall 52 of second cavity 18 toward a free end 54. As shown in FIGS. 1 and 2, cavity clip 20 extends across a substantial portion of second cavity 18 and forms an end wall, in particular the bottom end wall, of the second cavity. Cavity clip 20, in the unstressed position is biased inwardly into second cavity 18. Free end 54 includes two upwardly extending projections 56 which are substantially triangular in shape. This triangular shape is somewhat rounded and allows pump 50 to be placed in second cavity 18 while, at the same time, moving cavity clip 20 outwardly, that is, out away from the interior of the second cavity or to make the second cavity larger. With the pump 50 placed in second cavity 18, the cavity clip.20, and in particular the free end 54, exerts an inward force to maintain or hold pump 50 in second cavity 18. Pump 50 may be constructed so as to have one or more indents into which projections 56 can be matingly engaged to add additional force to maintain pump 50 in second cavity 18.

In addition, the back wall 52 of second cavity 18 includes a first portion 58 and a second portion 60 which extends somewhat rearwardly of first portion 58. Back wall 52 is provided with the non-aligned first and second portions 58 and 60 so that pump 50, which includes a rearwardly extending housing region 62, can be more accommodatingly fitted into second cavity 18.

When it is desired to remove pump 50 from second cavity 18, cavity clip 54 is manually grasped and moved away from pump 50. This movement allows pump 50 to be removed from second cavity 18.

Figure 6:
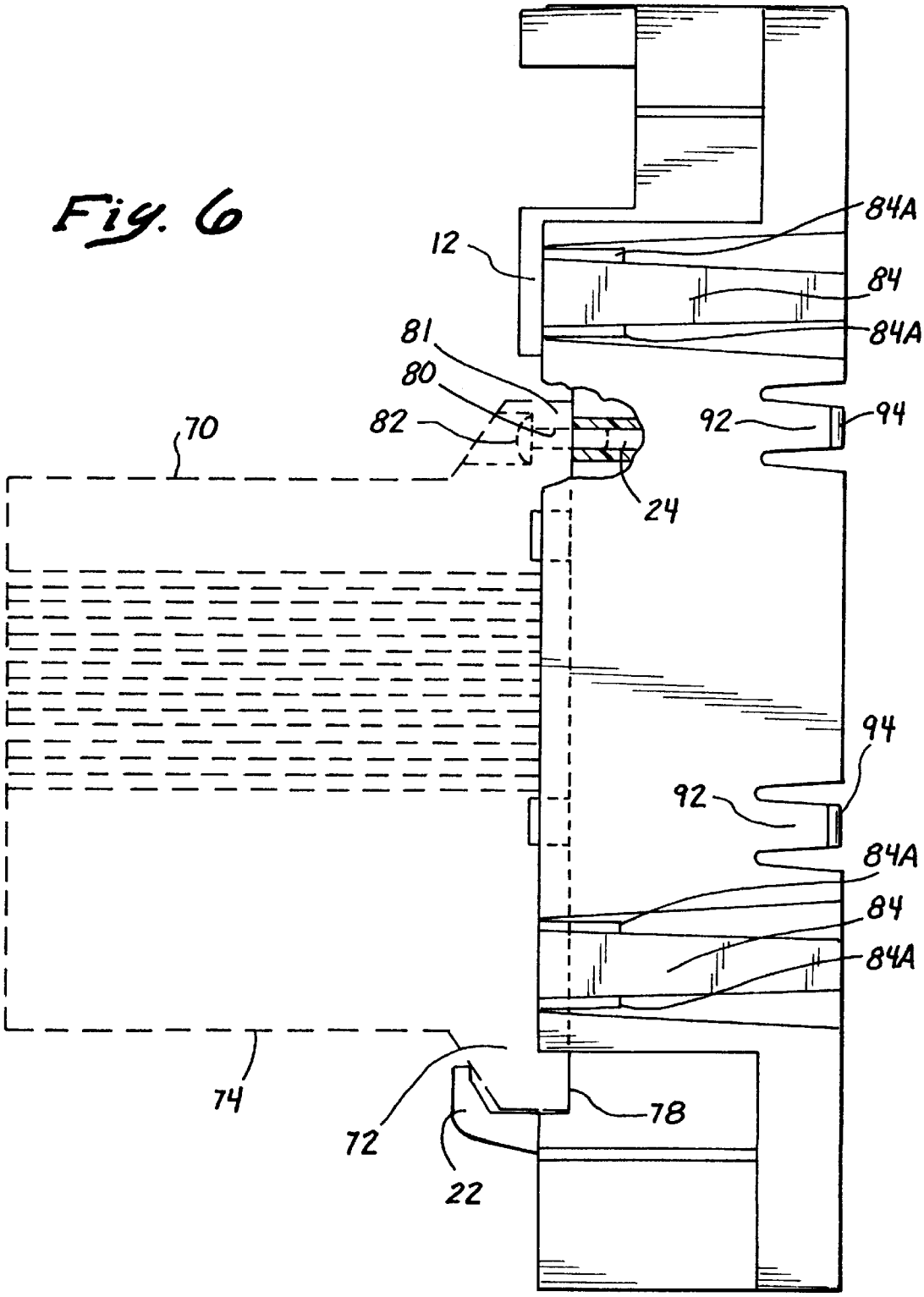
FIG. 6 is a side view, partly in cross-section, of an apparatus in accordance with the present invention holding a pump.

With particular reference to FIG. 6, a third set of elements, that is the combination of hooks 22 and holes 24, are shown holding pump 70 (in shadow lines) to housing 12. The pump 70 has a configuration similar to the pump sold by Flojet, Inc. under Model G55XX.

The enlarged portion 72 of the frame 74 of pump 70 is held to frame 12 by hooks 22. Moreover, frame 12 includes a recess 78 which extends between hooks 22. Recess 78 is configured to facilitate the holding of pump 70 to the housing 12 by hooks 22. Pump 70 includes two through bores 80 (only one shown in FIG. 6) which pass through an upper frame segment 81 of pump 70. Pins or screws 82 are placed into through bores 80 and into holes 24 where they are secured. Thus, the combination of hooks 22, holes 24 and pins or screws 82 are effective to hold pump 70 to housing 12.

As noted previously, each of the boards 10, 10A and 10B is joined or coupled to one or two of the other boards. With particular reference to FIGS. 1 and 2, this coupling is accomplished using two spaced apart projections 84 extending from the first sidewall 86 of each of the housings 12 and a corresponding or complementary pair of spaced apart recesses 88 located on the second sidewall 90 of each housing 12. Thus, adjacent boards 10, 10A and 10B can be joined or coupled together simply by placing the projections 84 of one board into the corresponding recesses 88 of the adjacent board. As shown in FIGS. 1 and 2, the projections 84 and recesses 88 are specially configured, for example, include projection keys 84A and complementary recess keys 88A, to provide a snug and secure fit between projections 84 and recesses 88.

In addition, with reference to FIGS. 1, 2, 3 and 6, the first sidewall 86 of each housing 12 includes a pair of spaced apart tabs 92 including a free end 94 extending away from the first sidewall 86. With particular reference to FIG. 3, the second sidewall 90 of each housing 12 includes two spaced apart shortened tabs 96 (only one shown). The shortened tabs 96 are positioned at locations on the second sidewall 90 of each housing 12 which correspond to the locations of the tabs 92 of the first sidewall 86.

With adjacent boards 10A and 10B coupled together, the free ends 94 of tabs 92 of one board extend below the shortened tabs 96 of the adjacent board. This combination provides an interlock which prevents the coupled boards from sliding forwardly or rearwardly relative to each other.

The boards can be uncoupled by merely manually pulling the free ends 94 of the tabs 92 of one board away from the shortened tabs 96 of the adjacent board. The coupled boards can then be separated simply by sliding the projections 84 of one board out of the recesses 88 of the adjacent board.

As shown best in FIG. 2, each housing 12 includes a series of eight (8) through bores 100. Fasteners 102 (FIG. 1), for example, screws, bolts or the like, are placed in the bores 100 to secure the housing 12 to a wall or other structural member, for example, in a restaurant, tavern or the like establishment dispensing beverages. One advantage of joining or coupling boards 10, 10A and 10B together is that a reduced number of fasteners 102 need be employed. For example, looking at FIG. 1, fasteners 102 need be placed in only the left most through bores 100 of board 10 and the right most through bores 100 of board 10B to secure the system 8 to a wall or other structural member.

System 8 can be pre-assembled at a facility remote from the restaurant, tavern or other establishment dispensing beverages. Thus, the individual boards 10A, 10B can be joined or coupled together as described above. In addition, it should be understood that the system may include a single board or two, three or more boards linked together. These joined or coupled boards formed into system 8 can then be brought to the beverage dispensing establishment and secured to a wall or other structural member. The various pumps and ASVs required by the establishment can then be placed in the boards of system 8, as described previously. The pumps and ASV held by system 8 are connected to the beverage containers, for example, bag-in-box containers including beverages and beverage components. The pumps are also connected to dispensing valves. At this point, the beverage dispensing system is ready for use, in a conventional manner.

Alternately, the pumps and ASV can be placed or held in the individual boards 10, 10A and 10B of system 8 at the remote site. This further reduces the assembly and installation work required at the beverage dispensing establishment. The system 8, including the associated pumps and ASV, is then secured to a wall or other structural member in the establishment. The pumps and ASV are connected to the containers including beverages and beverage components and to the beverage dispensing valves.

Over time, the ordered array of pumps and ASVs held to a series of boards in accordance with the present invention, such as system 8, very effectively provide for monitoring each of the pumps and ASVs, and allow for effectively maintaining the pumps and ASVs associated with each individual board of the system so that the beverage dispensing system in the establishment is operated effectively and efficiently.

While this invention has been described with respect to various specific examples and embodiments, it is to be understood that the invention is not limited thereto and that it can be variously practiced within the scope of the following claims.

What is claimed is:

1. In combination with a pump, an apparatus for holding any one of a plurality of differently configured pumps, said apparatus comprising:

a vertically mountable housing; and a plurality of different sets of elements located on said housing, each of said different sets of elements being adapted to at least assist in holding one of a plurality of differently configured pumps to the housing;

one of said different sets of elements including a first cavity defined by the housing and sized and adapted to receive a portion of one of a plurality of differently configured pumps, and a plurality of spaced apart clips extending in the first cavity and adapted to hold the received pump in the first cavity; and said first cavity adapted to receive a portion of either one of two similarly configured pumps of different sizes, and the plurality of spaced apart clips being adapted to hold the received portion of either one of two similarly configured pumps of different sizes.

2. The combination of claim 1 wherein said first cavity is further sized and adapted to receive a portion of an automatic selector valve and the plurality of spaced apart clips are further adapted to hold the received portion of the automatic selector valve in the first cavity.

3. The combination of claim 1 wherein each of the spaced apart clips is biased toward an interior of the first cavity and has a free end configured to contact the pump received in the first cavity.

4. In combination with a pump, an apparatus for holding any one of a plurality of differently configured pumps, the apparatus comprising:

a housing; and a plurality of different sets of elements located on said housing, each of said different sets of elements being adapted to at least assist in holding one of a plurality of differently configured pumps to the housing;

one of said different sets of elements including a second cavity defined by the housing, and a cavity clip defining a portion of the second cavity, the second cavity being sized and adapted to receive a portion of one of the plurality of differently configured pumps, and the cavity clip being adapted to hold the received portion of the pump in the second cavity; and said cavity clip being biased toward an interior of the second cavity and having a free end configured to contact the pump received in the second cavity.

5. An apparatus for holding any one of a plurality of differently configured pumps, the apparatus comprising:

a housing;

a plurality of different sets of elements located on said housing, each of said different sets of elements being adapted to at least assist in holding one of a plurality of differently configured pumps to the housing;

coupling means acting to cooperate with complementary coupling means of a similar apparatus to couple the apparatus to the similar apparatus; and anti-sliding means acting to cooperate with complementary anti-sliding means of a similar apparatus coupled to the apparatus to prevent the apparatus from sliding relative to the similar apparatus.

6. The apparatus of claim 5 wherein the anti-sliding means includes a flap extending from a first sidewall of the housing and a shortened flap extending from an opposing second sidewall of the housing, the flap having a free end which extends outwardly from the first sidewall and is adapted to be located in proximity to a complementary shortened flap of a similar apparatus coupled to the apparatus so that the free end of the flap extends below the complementary shortened flap of the similar apparatus, and the shortened flap being adapted to be located above a free end of a complementary flap of a similar apparatus coupled to the apparatus.

7. The apparatus of claim 6 wherein the anti-sliding means includes two flaps and two shortened flaps.

* * * * *